US011221581B2

(12) United States Patent
Meguro

(10) Patent No.: US 11,221,581 B2
(45) Date of Patent: Jan. 11, 2022

(54) CLEANING DEVICE AND IMAGE FORMING APPARATUS

(71) Applicant: Konica Minolta, Inc., Tokyo (JP)

(72) Inventor: Taichi Meguro, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/328,201

(22) Filed: May 24, 2021

(65) Prior Publication Data

US 2021/0373481 A1 Dec. 2, 2021

(30) Foreign Application Priority Data

May 28, 2020 (JP) ..... JP2020-092795

(51) Int. Cl.
*G03G 21/00* (2006.01)

(52) U.S. Cl.
CPC ..... *G03G 21/0011* (2013.01)

(58) Field of Classification Search
CPC ..... G03G 21/0011
See application file for complete search history.

(56) References Cited

U.S. PATENT DOCUMENTS

| | | | | |
|---|---|---|---|---|
| 7,395,005 | B2 * | 7/2008 | Takada | G03G 21/0011 399/101 |
| 8,953,973 | B2 * | 2/2015 | Aiba | G03G 21/0011 399/101 |
| 9,164,465 | B2 * | 10/2015 | Mori | G03G 21/0011 |
| 2020/0174402 | A1 * | 6/2020 | Meguro | G03G 15/161 |

FOREIGN PATENT DOCUMENTS

JP 2019-194647 11/2019

* cited by examiner

*Primary Examiner* — Walter L Lindsay, Jr.
*Assistant Examiner* — Milton Gonzalez
(74) *Attorney, Agent, or Firm* — BakerHostetler

(57) ABSTRACT

A cleaning device may include a cleaning blade that is in contact with an image carrier for cleaning, an applicating roller that is in contact with the image carrier at a position upstream compared to the cleaning blade, and a plate-like member that is in contact with the applicating roller. The plate-like member may be in contact with the applicating roller at a contact part which is not an edge of the plate-like member and may be arranged such that a space for reserving the toner is formed on an upper side of the contact part. An angle between a tangent line that passes the upper end of the plate-like member and touches the applicating roller on an upper side and a horizontal line that passes the upper end of the plate-like member may be larger than an angle of rupture of the toner reserved in the space.

8 Claims, 6 Drawing Sheets

T1

| COVERAGE OF LESS THAN 5% | | PAPER TYPE | |
|---|---|---|---|
| | | COATED PAPER | PAPER WITH DUST (RECYCLED PAPER) |
| ABSOLUTE HUMIDITY | LESS THAN 10.3 g/m$^3$ | 8 mm | 6 mm |
| | 10.3 g/m$^3$ OR MORE AND LESS THAN 14.6 g/m$^3$ | 7 mm | 5 mm |
| | MORE THAN 14.6 g/m$^3$ | 6 mm | 4 mm |

FIG. 8

T2

| COVERAGE OF 5% OR MORE | | PAPER TYPE | |
|---|---|---|---|
| | | COATED PAPER | PAPER WITH DUST (RECYCLED PAPER) |
| ABSOLUTE HUMIDITY | LESS THAN 10.3 g/m$^3$ | 8 mm | 7 mm |
| | 10.3 g/m$^3$ OR MORE AND LESS THAN 14.6 g/m$^3$ | 8 mm | 6 mm |
| | MORE THAN 14.6 g/m$^3$ | 7 mm | 5 mm |

FIG. 9

T3

| SLIDING DISTANCE OF APPLICATING ROLLER 0 km OR MORE AND LESS THAN 100 km | | | |
|---|---|---|---|
| COVERAGE OF LESS THAN 5% | | PAPER TYPE | |
| | | COATED PAPER | PAPER WITH DUST (RECYCLED PAPER) |
| ABSOLUTE HUMIDITY | LESS THAN 10.3 g/m$^3$ | 8 mm | 6 mm |
| | 10.3 g/m$^3$ OR MORE AND LESS THAN 14.6 g/m$^3$ | 7 mm | 5 mm |
| | MORE THAN 14.6 g/m$^3$ | 6 mm | 4 mm |

FIG. 10

T4

| SLIDING DISTANCE OF APPLICATING ROLLER 100 km OR MORE AND LESS THAN 150 km | | | |
|---|---|---|---|
| COVERAGE OF LESS THAN 5% | | PAPER TYPE | |
| | | COATED PAPER | PAPER WITH DUST (RECYCLED PAPER) |
| ABSOLUTE HUMIDITY | LESS THAN 10.3 g/m$^3$ | 7.5 mm | 5.5 mm |
| | 10.3 g/m$^3$ OR MORE AND LESS THAN 14.6 g/m$^3$ | 6.5 mm | 4.5 mm |
| | MORE THAN 14.6 g/m$^3$ | 5.5 mm | 3.5 mm |

FIG. 11

T5

| SLIDING DISTANCE OF APPLICATING ROLLER 150 km OR MORE AND 200 km OR LESS | | | |
|---|---|---|---|
| COVERAGE OF LESS THAN 5% | | PAPER TYPE | |
| | | COATED PAPER | PAPER WITH DUST (RECYCLED PAPER) |
| ABSOLUTE HUMIDITY | LESS THAN 10.3 g/m$^3$ | 7 mm | 5 mm |
| | 10.3 g/m$^3$ OR MORE AND LESS THAN 14.6 g/m$^3$ | 6 mm | 4 mm |
| | MORE THAN 14.6 g/m$^3$ | 5 mm | 3 mm |

FIG. 12

T6

| NUMBER OF SHEETS [kp] | CONVENTIONAL CONFIGURATION | | EMBODIMENT | |
|---|---|---|---|---|
| | ACCUMULATION OF TONER IN SPACE B | FOREIGN MATERIAL MESHING AND SLIPPING THROUGH | ACCUMULATION OF TONER IN SPACE B | FOREIGN MATERIAL MESHING AND SLIPPING THROUGH |
| 0 | GOOD | GOOD | GOOD | GOOD |
| 50 | GOOD | GOOD | GOOD | GOOD |
| 100 | FAIR | GOOD | GOOD | GOOD |
| 200 | FAIR | FAIR (RESOLVED AFTER SEVERAL SHEETS) | GOOD | GOOD |
| 300 | POOR | POOR | GOOD | GOOD |
| 400 | POOR | POOR | FAIR | GOOD |

CLEANING DEVICE AND IMAGE FORMING APPARATUS

CROSS-REFERENCE TO RELATED APPLICATIONS

This application claims priority to Japanese Patent Application No. 2020-092795 filed on May 28, 2020, the entire disclosure of which is incorporated herein by reference in its entirety.

BACKGROUND

Technological Field

The present disclosure relates to a cleaning device and an image forming apparatus.

Description of the Related Art

Conventionally, there have been electrophotographic image forming apparatuses, in which a toner image is formed by developing an electrostatic image formed on a photoreceptor, and is transferred onto a sheet by a transfer unit, and the transferred toner image is fixed on the sheet by a fixing unit so as to form an image on the sheet.

For the electrophotographic method, there is known a technique of using a rubber blade for cleaning an intermediate transfer belt. Specifically, in such a technique, a static layer is formed on an edge of blade (blade edge) by an external additive added to the toner so as to block and clean the toner. The static layer has also a function of preventing the blade edge from being dragged. Specifically, it prevents a phenomenon (dragging) where the blade edge is pulled by the intermediate transfer belt to a significant extent as a minute amount of the external additive not trapped by the blade edge decreases an area of substantial contact between the rubber blade and the intermediate transfer belt.

For example, the static layer is depleted when the external additive (toner) is not supplied for a long time in continuous printing of light-coverage images. When the static layer is depleted, the external additive is not slipped from the static layer functioning as a spacer. The rubber blade is then directly in contact with the intermediate transfer belt, increasing a frictional force between the rubber blade and the intermediate transfer belt, and the rubber blade is worn to a significant amount (cut surface wear). If printing is continued when the cut surface of the rubber blade is worn, the blade edge is damaged from the cut surface, resulting in cleaning errors. In order to avoid the cut surface wear in the rubber blade, it is necessary to constantly supply toner to the blade edge.

Thus, there has been disclosed a configuration (overflow method) in which an applicating roller which can supply toner is provided at a position upstream of a rubber blade (for example, see JP2019194647A). Specifically, a plate-like member for applying toner onto the applicating roller is provided to abut the applicating roller at a position upstream of the rubber blade. A contact force of the plate-like member is set to more than 5 N and less than 40 N, and a pressure of the applicating roller to an image carrier is set to 0.5 N or more and less than 40 N. The toner applied onto the surface of the applicating roller by the plate-like member may thereby be supplied in an adequate amount to the image carrier by the pressure of the applicating roller.

As a contact force of the plate-like member is increased, the amount of toner applied onto the applicating roller surface is increased. In a case where the plate-like member is in contact with the applicating roller at the edge with a contact force exceeding some level, the toner on the applicating roller may be scraped off, or the surface of the applicating roller may deteriorate. Thus, in the case where the plate-like member is in contact with the applicating roller at the edge, a range of the settable contact force is narrowed, and a target applicability of the toner may not be maintained by a deviation. In the configuration disclosed in JP2019194647A, as the plate-like member is not in contact with the applicating roller at the edge, it is possible to avoid scraping the toner on the applicating roller or deterioration of the applicating roller surface, and also possible to obtain a wide range of the settable contact force of the plate-like member.

SUMMARY

In a case where there is a lot of paper dust and lubricant, aggregates of paper dust and lubricant are sometimes caught at the edge of the rubber blade. Such aggregates may be removed by control of rotating the intermediate transfer belt in the reverse direction at predetermined timings (reverse rotation control).

However, in a configuration using the overflow method as in JP2019194647A described above, in a case where the flow of reserved toner stagnates, the effect of the reverse rotation control is not adequately produced as described as follows.

Specifically, the flow of the reserved toner in a space A (a space formed by a protruding part of a plate-like member 103 and an applicating roller 102; see FIG. 4) is stagnant, an angle of rupture of the reserved toner (an angle when the reserved toner is ruptured by slight vibration caused by sliding loads between the plate-like member 103 and the applicating roller 102 and between the intermediate transfer belt T and the applicating roller 102; see FIG. 5) is increased. The reserved toner thereby accumulates over the draft line L2 (a horizontal line passing the upper end of the plate-like member 103; see FIG. 5). The reserved toner that exceeds the draft line L2 gradually accumulates to flow toward a space B (a space formed by the intermediate transfer belt T and the applicating roller 102; see FIG. 4) and reaches the space B. When the toner is reserved in the space B, the aggregates removed from the edge by the reverse rotation control is retained by the toner in the space B and enters the edge at the start of the next printing.

The present disclosure has an object of providing a cleaning device and an image forming apparatus that can prevent occurrence of cleaning errors caused by foreign substances aggregated on an edge of a cleaning blade.

To achieve at least one of the abovementioned objects, according to an aspect of the present disclosure, a cleaning device reflecting one aspect of the present disclosure includes a cleaning blade that is in contact with an image carrier and that cleans the image carrier; an applicating roller that is in contact with the image carrier at a position upstream of a part where the cleaning blade is in contact with the image carrier in a conveying direction of the image carrier; and a plate-like member that is in contact with the applicating roller and that applies the toner onto the applicating roller, wherein the plate-like member is in contact with the applicating roller at a contact part which is not an edge of the plate-like member and is arranged such that a space for reserving the toner is formed on an upper side of the contact part, wherein an upper end of the plate-like member is lower than a lower end of the cleaning blade and an upper end of the applicating roller, wherein an angle between a tangent line that passes the upper end of the plate-like member and that touches the applicating roller on an upper side and a horizontal line that passes the upper end of the plate-like member is larger than an angle of rupture of the toner reserved in the space.

An image former reflecting another aspect of the present disclosure that forms an image on a sheet includes: an image carrier with a surface on which a toner image is to be formed; a transfer unit that transfers the toner image formed on the surface of the image carrier onto the sheet; and the cleaning device according to claim 1 that removes a residue on the surface of the image carrier after the transfer unit transfers the toner image.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure, wherein:

FIG. 8 is an exemplary table when the coverage is 5% or more;

FIG. 9 is an exemplary table when the coverage is less than 5% and a sliding distance of an applicating roller is 0 km or more and less than 100 km;

FIG. 10 is an exemplary table when the coverage is less than 5% and the sliding distance of the applicating roller is 100 km or more and less than 150 km;

FIG. 11 is an exemplary table when the coverage is less than 5% and the sliding distance of the applicating roller is 150 km or more and less than 200 km; and FIG. 12 shows an example of comparison of effects between the configuration of the cleaning device according to the embodiment and a conventional configuration limitation of a protrusion of the plate-like member.

DETAILED DESCRIPTION OF THE EMBODIMENTS

Hereinafter, one or more embodiments of the present disclosure will be described in detail with reference to the drawings. However, the scope of the disclosure is not limited to the disclosed embodiments.

Figure 1:
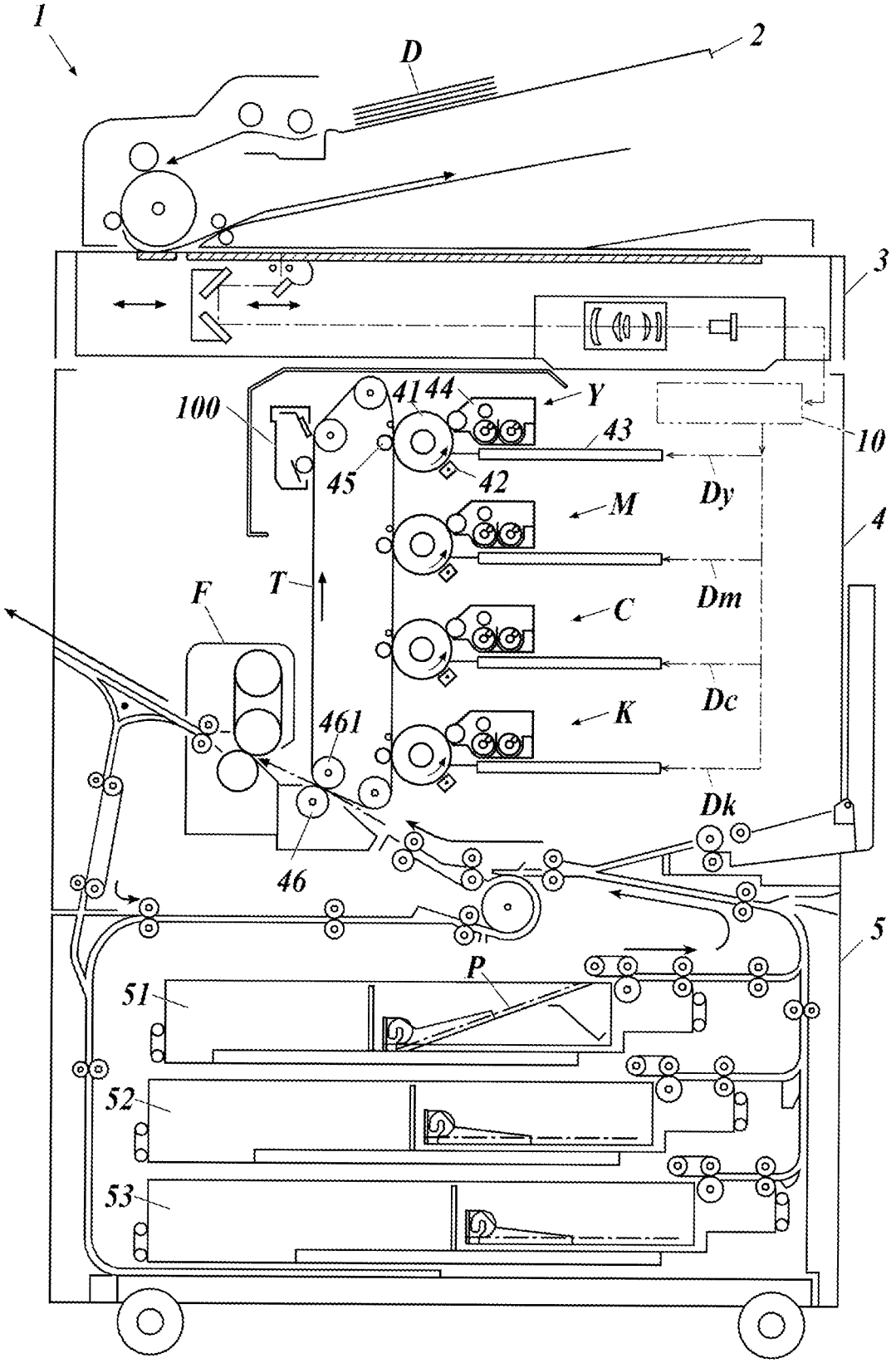
FIG. 1 shows a schematic configuration of an image forming apparatus according to an embodiment.
Figure 2:
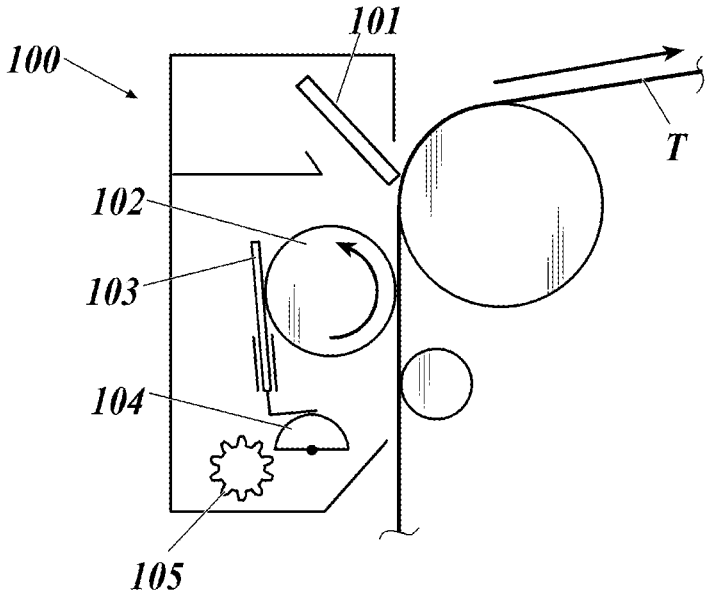
FIG. 2 shows a schematic configuration of a cleaning device.
Figure 3:
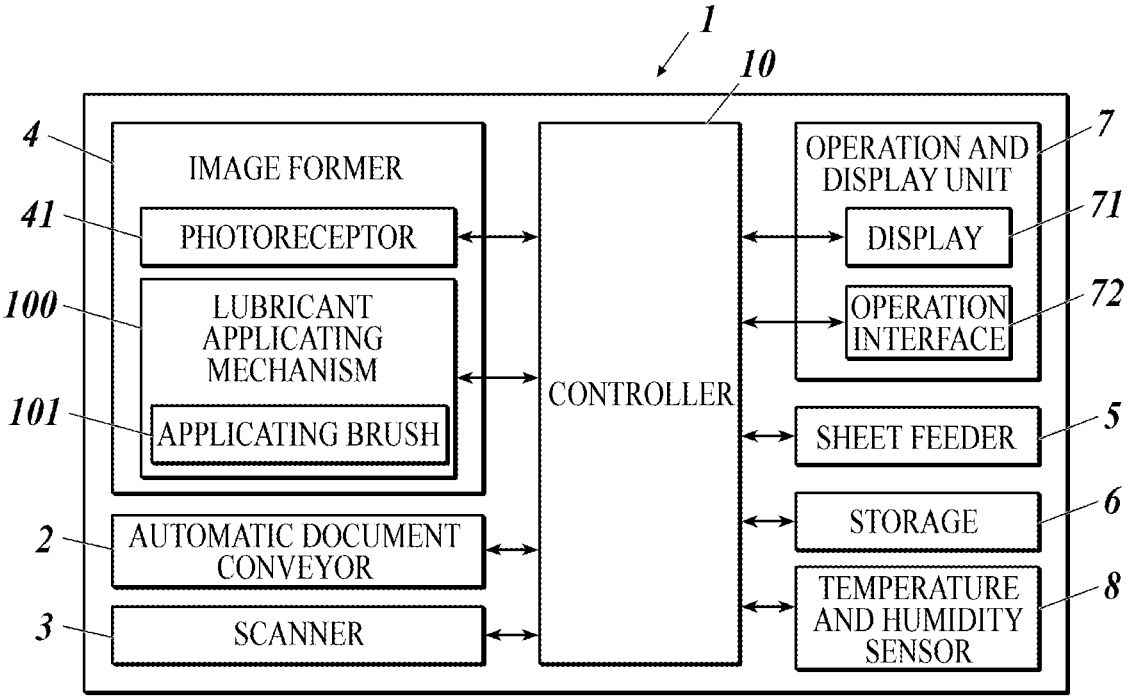
FIG. 3 is a functional block diagram showing a control structure of the image forming apparatus according to the embodiment.

The image forming apparatus 1 according to this embodiment is an intermediate transfer type color image forming apparatus using the technique of electrophotographic process. As shown in FIGS. 1 to 3, the image forming apparatus 1 includes an automatic document conveyor 2, a scanner 3, an image former 4, a sheet feeder 5, a storage 6, an operation and display unit 7, a temperature and humidity sensor 8, and a controller 10.

The automatic document conveyor 2 includes a placement tray to place a document D thereon, a mechanism and a conveying roller to convey the document D to convey the document D to a predetermined conveying path.

The scanner 3 is provided with an optical system such as an optical source and a reflecting mirror. The optical source irradiates the document D conveyed on the predetermined conveying path or the document D placed on a platen glass, and the scanner 3 receives the reflected light. The scanner 3 converts the received reflected light to an electric signal and outputs the electric signal to the controller 10.

The image former 4 includes a yellow imager Y, a magenta imager M, a cyan imager C, a black imager K, an intermediate transfer belt T, and a fixer F.

The imagers YMCK respectively form a toner image in yellow, magenta, cyan, or black on a photoreceptor 41, and the toner images in the colors YMCK formed on the photoreceptor 41 are transferred by primary transfer on the intermediate transfer belt T. The imagers YMCK each include a photoreceptor 41, a charging device 42, an exposure device 43, a developing device 44, a primary transfer roller 45, a secondary transfer roller 46, a cleaning device 100, as shown in FIGS. 1 and 2. The configuration and the operation are the same for all images YMCK. Therefore, hereinbelow, the flow of the image forming operation performed by the image former 4 is described with reference to the yellow imager Y as the example.

The photoreceptor 41 includes an organic photoconductor in which a photoconductor layer is formed with resin including an organic photoconductor on an outer circumferential surface of a drum-shaped metallic base, and the photoreceptor 41 is rotationally driven. The resin included in the photoconductor layer may be polycarbonate resin, silicone resin, polystyrene resin, acrylic resin, methacrylic resin, epoxy resin, polyurethane resin, vinyl chloride resin, melamine resin, for example.

The charging device 42 uses a charger to charge the photoreceptor 41 to a certain electric potential.

The exposing device 43 exposes a non-image region of the photoreceptor 41 based on image data Dy from the controller 10 to remove charge of the exposed part and forms the electrostatic latent image in the image region of the photoreceptor 41.

The developing device 44 supplies toner, which is developer, on an electrostatic image formed on the photoreceptor 41, and a yellow toner image on the photoreceptor 41.

Primary transfer is performed by using the primary transfer roller 45 to transfer the yellow toner image formed on the photoreceptor 41 onto the intermediate transfer belt T. Similarly for the imagers MCK, primary transfer is performed to transfer the toner images in magenta, cyan, and black onto the intermediate transfer belt T. With this, the toner images with the colors YMCK are formed on the intermediate transfer belt T.

The intermediate transfer belt T (image carrier) is a semi-conductive endless belt hung around a plurality of rollers to be supported in a rotatable state. The intermediate transfer belt T is rotationally driven with the rotation of the rollers. The intermediate transfer belt T is pressed against the opposing photoreceptor 41 by the primary transfer roller 45. The transfer electric current according to the applied voltage flows in each primary transfer roller 45. The primary transfer is performed and each of the toner images developed on the surface of each photoreceptor 41 is successively transferred to the intermediate transfer belt T by the primary transfer roller 45.

The secondary transfer roller 46 (transfer unit) is pressed by the intermediate transfer belt T and is rotated in a manner following the intermediate transfer belt T. With this, the secondary transfer is performed and the toner images in the colors YMCK transferred and formed on the intermediate transfer belt T are transferred on a sheet P conveyed from sheet feeding trays 51 to 53 of the sheet feeder 5. The secondary transfer roller 46 is positioned in contact with the secondary transfer opposing roller 461 with the intermediate transfer belt T in between. When the sheet P passes a transfer nip formed between the secondary transfer roller 46 and the secondary transfer opposing roller 461, the secondary transfer is performed and the toner image on the intermediate transfer belt T is transferred onto the sheet P.

The image former 4 uses the fixer F to heat and press the sheet P on which the toner images in the colors YMCK are transferred by the secondary transfer and then passes the sheet P through the predetermined conveying path to eject the sheet P outside the apparatus.

The flow of processes described above is the image forming process performed by the image former 4.

The cleaning device 100 includes a cleaning blade 101, an applicating roller 102, a plate-like member 103, an actuator 104, and a waste toner screw 105, as shown in FIG. 2.

The cleaning blade 101, which is in contact with the intermediate transfer belt T, cleans the intermediate transfer belt T by removing residual toner, residues of paper dust, external additive, and the like remaining on the intermediate transfer belt T after the secondary transfer. The ranges of the material and the conditions of contact (contact pressure and contact angle) of the cleaning blade 101 are not limited as long as a predetermined cleaning performance is ensured with respect to the amount of entering toner. In this embodiment, the cleaning blade 101 is a urethane rubber blade, and has a contact pressure of 15 to 40 N/m and a contact angle of 12° to 23°. This ensures good cleaning performance.

The applicating roller 102 is in contact with the intermediate transfer belt T at a position upstream compared to the cleaning blade 101 in the conveying direction of the intermediate transfer belt T, and applies toner onto the intermediate transfer belt T. The applicating roller 102 preferably includes an elastic layer. With an elastic layer, the applicating roller 102 has predetermined nips formed at parts respectively in contact with the plate-like member 103 and the intermediate transfer belt T. In a case where the axis of the applicating roller 102 is oblique in the longitudinal direction, the applicating roller 102 may be prevented from being completely separated from the plate-like member 103 and the intermediate transfer belt T.

The elastic layer is preferably made of foamed sponge. With the elastic layer of formed sponge, toner may be trapped in foam cells on the surface of the applicating roller 102, making it possible to ensure a sufficient amount of adhered toner on the applicating roller 102. The elastic layer (sponge layer) preferably has a cell diameter of 100 um to 350 um, and a cell occupancy rate of 30% or more and less than 70% per unit area. That is because, in a case where the elastic layer has a cell diameter of less than 100 um or a cell occupancy rate of less than 30% per unit area, it is impossible to ensure a necessary amount of toner on the applicating roller 102 and therefore impossible to ensure an amount of the adhered toner (belt adhesion amount) of the cleaning blade 101 of 0.5 g/m$^2$ on the intermediate transfer belt T required for avoiding wear of the cut surface on the intermediate transfer belt T. In a case where the elastic layer has a cell diameter of more than 70%, the areas of contact of the sponge layer (non-cell part) with the intermediate transfer belt T and the plate-like member 103 are small, and the pressure with the intermediate transfer belt T and the contact pressure with the plate-like member 103 are applied to the sponge layer (non-cell part) altogether and break the cell frames. It is thus impossible to ensure the amount of the adhered toner in the last period before wearing out. In the case where the elastic layer has a cell diameter of more than 350 um, the sponge layer is coarse in the thickness direction, and the pressure with the intermediate transfer belt T and the contact pressure with the plate-like member 103 reduces the sponge, decreasing the external diameter of the applicating roller 102. It is thus impossible to ensure the amount of the adhered toner in the last period before wearing out.

Figure 4:
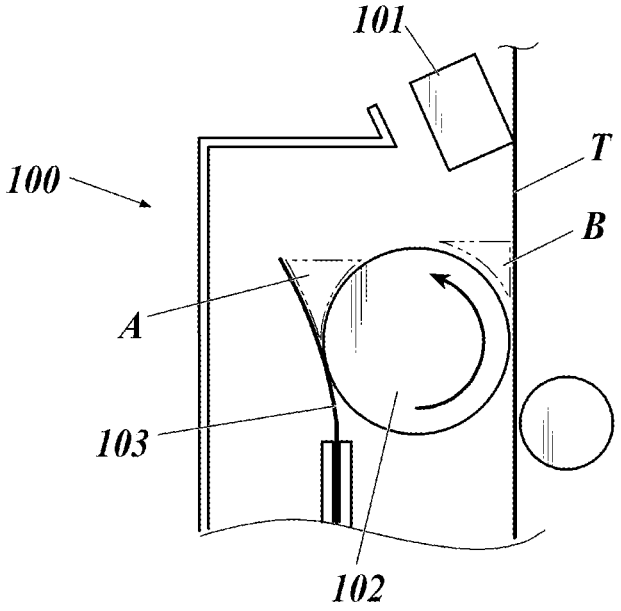
FIG. 4 is an explanatory drawing for showing a space A and a space B in the cleaning device.

The plate-like member 103 is in contact with the applicating roller 102, and applies toner onto the applicating roller 102. A part which is not the edge of the plate-like member of the plate-like member 103 is in contact with the applicating roller 102. The plate-like member 103 is placed such that a space A for storing toner at the upper side of the applicating roller 102 (a space formed by the protruding part of the plate-like member 103 and the applicating roller 102; see FIG. 4). The plate-like member 103 applies the toner reserved in the space A (reserved toner) onto the applicating roller 102. The toner exceeding the capacity of the space A is ejected downward from the upper end of the plate-like member 103.

Figure 5:
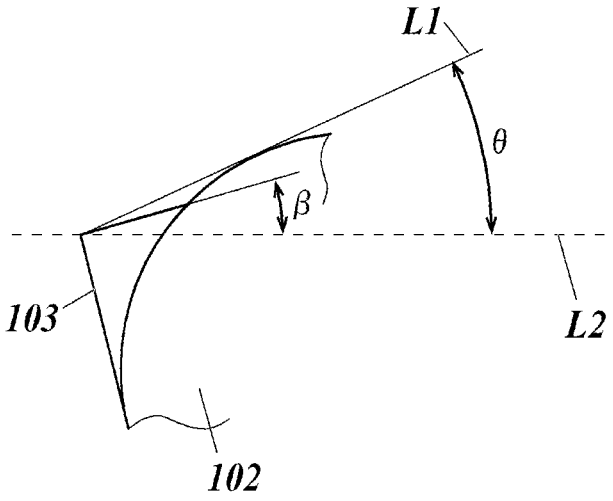
FIG. 5 is an explanatory drawing for showing an angle θ and an angle of rupture β of reserved toner.

The upper end of the plate-like member 103 is lower than the lower end of the cleaning blade 101 and the upper end of the applicating roller 102. As shown in FIG. 5, an angle θ between the tangent line L1 that passes through the upper end of the plate-like member 103 and touches the upper side of the applicating roller 102 and the horizontal line (draft line) L2 that passes through the upper end of the plate-like member 103 is larger than an angle of rupture β (an angle when the reserved toner is ruptured by slight vibration caused by sliding loads between the plate-like member 103 and the applicating roller 102 and between the intermediate transfer belt T and the applicating roller 102). This makes it possible to avoid accumulation of toner in the space B (the space formed by the intermediate transfer belt T and the applicating roller 102; see FIG. 4).

The cleaning device 100 according to the present disclosure was mounted on the actual AccurioPress C3080, and the angle of rupture β was measured by observing the cross-section of the reserved toner in the space A after predetermined printing. The angle of rupture may be measured using JIS R 9301-2-2 or IOS902. In that case, the angle of rupture β is an angle of repose when vibration produced in the actual apparatus is reproduced.

In general, the angle of rupture β is varied by the fluidity (in a range of 3° to 40°, and it is therefore necessary to set an angle θ that allows the variation. That is, it is necessary to set the angle θ to a value larger than 40°, which is the angle of rupture β in the worst state of the liquidity.

For example, with the applicating roller 102 having an outer diameter of Φ16, as the protrusion amount of the plate-like member 103 is set to 3 mm, the angle θ may be set to 49°. In that case, it is possible to avoid accumulation of toner in the space B even in the worst state of the liquidity (at an angle of rupture of 40°). The outer diameter of the applicating roller 102 and the protrusion amount of the plate-like member 103 are not limited as long as the angle θ is larger than 40°.

The plate-like member 103 is preferably a metal plate spring. That is because, if the plate-like member 103 is a PET (polyethylene terephthalate) or metal non-plate spring, the plate-like member 103 creeps and the capacity of application onto the applicating roller 102 gets insufficient to supply a required amount of toner to the blade edge. In this embodiment, SUS304-CSP is used as the metal plate spring to avoid creep deformation. The material of the metal plate spring is not limited, and SUS301-CSP, SUS631-CSP, or the like may be used.

Figures 6, 7:
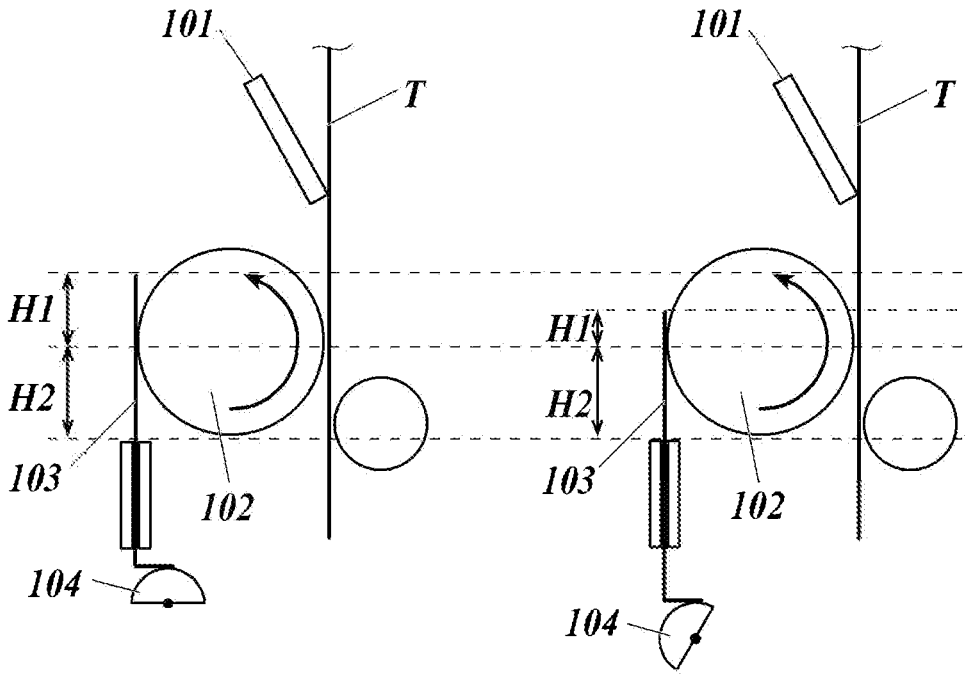
FIG. 6 shows an example of how an upper end position of a plate-like member is changed.
FIG. 7 is an exemplary table when coverage is less than 5%.

The actuator (changer) 104 is a mechanism for changing the position of the upper end of the plate-like member 103. The actuator 104 changes the length from the point of contact with the applicating roller 102 to the upper end (protrusion amount H1) of the plate-like member 103 only, as shown in FIG. 6, and does not change the length (free length H2) from the starting point of deflection (supporting point) to the point of contact (contact point) with the applicating roller 102 of the plate-like member 103. That is, the length from the starting point of deflection to the point of contact with the applicating roller 102 of the plate-like member 103 is always constant. This makes it possible to prevent the capacity of application of the reserved toner by the applicating roller 102 onto the intermediate transfer belt T.

The waste toner screw 105, which is rotatably driven in a predetermined direction by a driving unit, collects toner falling from above and ejects the collected toner.

In the cleaning device 100 described above, it is preferable that the contact force of the plate-like member 103 is set to 5 N or more and less than 40 N to control the toner adhesion amount on the applicating roller 102 in a range of 5 $g/m^2$ or more and less than 50 $g/m^2$. That is because, with a contact force of less than 5 N, it is impossible to apply a sufficient amount of toner onto the applicating roller 102, and the adhesion amount on the belt gets 0.5 $g/m^2$ or less, causing wear of the cut surface of the cleaning blade 101. With a contact force of more than 40 N, a large amount of toner is applied onto the applicating roller 102, and the adhesion amount on the belt exceeds the cleaning limit of the cleaning blade 101, resulting in cleaning errors.

In the cleaning device 100 described above, it is preferable that the pressure force of the applicating roller 102 to 0.5 N or more and less than 40 N to control the adhesion amount on the intermediate transfer belt T in a range of 0.5 $g/m^2$ or more and less than 4 $g/m^2$. That is because, with a pressure force of less than 5 N, toner is not transferred from the applicating roller 102 to the intermediate transfer belt T, and the adhesion amount on the belt gets 0.5 $g/m^2$ or less, and causing wear of the cut surface of the cleaning blade 101. With a pressure force of more than 40 N, a large amount of toner is transferred from the applicating roller 102 to the intermediate transfer belt T, and the adhesion amount on the belt exceeds the cleaning limit of the cleaning blade 101, causing cleaning errors.

It is more preferable that the contact force of the plate-like member 103 is set to 15 N or more and 30 N or less and that the pressure force of the applicating roller 102 is set to 10 N or more and 20 N or less. In general, the adhesion amount on the belt may vary due to external disturbances in the usage environment of the apparatus or the like. However, with the setting shown above, it is possible to maintain the adhesion amount on the belt required to avoid wear of the cutting surface of the cleaning blade 101 even when affected by external disturbances.

The sheet feeder 5 includes a plurality of sheet feeding trays 51 to 53, and a plurality of different types of sheets P are stored in each sheet feeding tray 51 to 53. The sheet feeder 5 feeds the stored sheet P to the image former 4 through the predetermined conveying path.

The storage 6 includes an HDD (Hard Disk Drive), a semiconductor memory, and the like, and stores data such as the program data and various setting data in a rewritable state under the control of the controller 10.

The operation and display unit 7 includes a liquid crystal display (LCD) with a touch panel and functions as a display 71 and an operation interface 72.

The display 71 displays various operation screens and an operation status of various functions according to a display control signal input from the controller 10. The display 71 receives touch operation by the user and outputs the operation signal to the controller 10.

The operation interface 72 includes various operation keys such as numeric keys and a start key, and receives various input operation by the user and outputs the operation signal to the controller 10. The user operates the operation/display unit 7 to perform operation such as setting regarding the image forming including image quality setting, magnification setting, advanced setting, output setting, and paper setting, paper conveying instruction, and operation to stop the apparatus.

The temperature and humidity sensor 8 detects information on the temperature and humidity in the image forming apparatus 1 and outputs the information to the controller 10.

The controller 10 includes a CPU, a RAM, and a ROM. The CPU deploys various programs stored in the ROM to the RAM and in coordination with the various deployed programs, the controller 10 centrally controls the operations of the units in the image forming apparatus 1, the automatic document conveyor 2, the scanner 3, the image former 4, the sheet feeder 5, the storage 6, the operation and display unit 7, and the temperature and humidity sensor 8 (see FIG. 3). For example, the controller 10 inputs the electric signals from the scanner 3 to perform various kinds of image processing, and outputs the image data Dy, Dm, Dc, and Dk of the colors YMCK generated by the image processing to the image former 4. The controller 10 controls the operations of the image former 4 to form images on the sheet P.

The controller 10 interrupts printing at a predetermined timing and rotates the intermediate transfer belt T in the reverse direction (reverse rotation control) to bring back foreign substances (external additive and lubricant from toner and paper dust from sheets) that reach the edge of the cleaning blade 101 (blade edge) to the applicating roller 102 and scrape them off. This prevents occurrence of cleaning errors caused by foreign substances aggregated on the blade edge (foreign substance meshing and slipping). For example, the controller 10 performs the reverse rotation control at intervals of 27 m of running of the intermediate transfer belt T, and prevents foreign substances from meshing and slipping.

In this embodiment, the protrusion amount of the plate-like member 103 is set in the regular operation such that the angle $\theta$ is larger than the angle of rupture $\beta$. This can suppress accumulation of the reserved toner in the space B. However, as the protrusion amount of the plate-like member 103 is set based on the angle of rupture $\beta(=40°)$ while the fluidity is worst, the amount of the reserved toner in the space A is decreased while the fluidity is not worsened, and the reserved toner in the space A may be run out. In general, the fluidity of the reserved toner greatly varies according to the temperature and humidity in the apparatus, the usage by users such as a used paper type, and therefore it is difficult to deal with every usage by a single setting. Against that difficulty, as the protrusion amount of the plate-like member 103 is controlled and set to an appropriate amount according to the fluidity of the reserved toner, it is possible to prevent the toner from being reserved in the space B and prevent the reserved toner in the space A from running out in all operating conditions.

Thus, in this embodiment, the fluidity of the reserved toner is estimated based on the usage by users of the apparatus, and the upper edge position of the plate-like member 103 is changed (upper end position adjustment operation). This makes it possible to prevent the toner from being reserved in the space B and prevent the reserved toner in the space A from running out. In this embodiment, the actuator 104 is controlled so as to change the upper end position of the plate-like member 103 also during printing.

The absolute humidity in the apparatus, the sheet coverage, and the paper type affect the fluidity of the reserved toner. The absolute humidity and the coverage affect the adhesivity of the reserved toner, and the paper type affects the paper dust inclusion. The fluidity of the reserved toner gets worst when the absolute humidity in the apparatus is high, the sheet coverage is light, and the paper type that generates a lot of paper dust such as recycled paper is used.

In this embodiment, tables of information on the absolute humidity, the coverage, and the paper type and the suitable protrusion amount of the plate-like member 103 according to the conditions are created (see FIGS. 7 and 8) and the protrusion amount of the plate-like member 103 is varied based on the tables. That is, the controller 10 controls the actuator 104 so as to change the upper end position of the plate-like member 103 based on at least one of the absolute humidity, the coverage, and the paper type. An exemplary table TA1 with a coverage of lower than 5% is shown in FIG. 7, and an exemplary table TA2 with a coverage of 5% or more is shown in FIG. 8. The absolute humidity is calculated from the temperature and the humidity detected by the temperature and humidity sensor 8, for example. The paper type is input by the user via the operation interface 72.

As shown in FIGS. 7 and 8, the protrusion amount of the plate-like member 103 is smaller when the fluidity of the reserved toner is worse. When the fluidity of the reserved toner gets worse, the protrusion amount of the plate-like member 103 can be decreased to increase the value of the angle θ, and it is possible to prevent the toner from being reserved in the space B. On contrary, when the fluidity of the reserved toner is not worsened, the protrusion amount of the plate-like member 103 can be increased, making it possible to prevent the reserved toner in the space A from running out.

It is more preferable that the values of the protrusion amount of the plate-like member 103 in the tables are changed according to the sliding distance of the applicating roller 102. This is because the angle of rupture of the reserved toner increases as wear of the applicating roller 102 progresses. Specifically, as wear of the applicating roller 102 progresses, the outer diameter is decreased, or the cells on the peripheral surface of the applicating roller 102 are filled with toner to cause the peripheral surface of the applicating roller 102 to be smoothed. That may decrease the sliding loads between the plate-like member 103 and the applicating roller 102 and between the image carrier and the applicating roller 102. In general, the angle of repose is transferred to the angle of rupture by minute vibration added to the reserved toner in the space A by the sliding loads of the applicating roller 102. When wear of the applicating roller 102 progresses and the sliding load is decreased, the angle of rupture is increased.

Therefore, in this embodiment, tables of the protrusion amount of the plate-like member 103 according to the sliding distance of the applicating roller 102 are created (see FIGS. 9 to 11) and the protrusion amount of the plate-like member 103 is varied based on the tables. That is, the controller 10 controls the actuator 104 so as to change the upper end position of the plate-like member 103 based on the sliding distance of the applicating roller 102. The controller 10 functions also as a detector to detect the sliding distance of the applicating roller 102. Here, the sliding distance of the applicating roller 102 may be substituted by the running distance of the intermediate transfer belt T. Specifically, the controller 10 calculates the running distance of the intermediate transfer belt T by integrating a linear speed of the intermediate transfer belt T with respect to a driving time of the drive motor of the intermediate transfer belt T for each job, and the calculated running distance of the intermediate transfer belt T is detected as the sliding distance of the applicating roller 102. An exemplary table TA3 with a coverage of lower than 5% and a sliding distance of the applicating roller 102 of more than 0 km and less than 100 km is shown in FIG. 9, an exemplary table TA4 with a coverage of less than 5% and a sliding distance of the applicating roller 102 of 100 km or more and less than 150 km in FIG. 10, and an exemplary table TA5 with a coverage of less than 5% and a sliding distance of the applicating roller 102 of 150 km or more and less than 200 km in FIG. 11.

As shown in FIGS. 9 to 11, the protrusion amount of the plate-like member 103 is controlled and set to a lower amount as the sliding distance of the applicating roller 102 is longer. That is, when the sliding distance of the applicating roller 102 gets longer, the protrusion amount of the plate-like member 103 can be decreased to increase the value of the angle θ, making it possible to prevent the toner from being reserved in the space B. On contrary, when the siding distance of the applicating roller 102 is shorter, the protrusion amount of the plate-like member 103 may be increased. Thus it is possible to prevent the reserved toner in the space A from running out.

When light-coverage printing is continuously performed, the toner in the developing device 44 deteriorates. To avoid that, the deteriorated toner (band image for developer deterioration prevention) is output on the intermediate transfer belt T at a predetermined timing and is ejected to the cleaning device 100. When a large amount of band images are supplied to the cleaning device 100 in a short period, the angle of the reserved toner cannot transfer from the angle of repose to the angle of rupture (that is, cannot eject the reserved toner) and may exceed the angle θ in some cases.

Thus, in this embodiment, when the band image for developer deterioration prevention is supplied, the upper end position of the plate-like member 103 is lowered to the (settable) lower limit. When a sufficient time for transfer from the angle of repose to the angle of rupture has elapsed after the band image for developer deterioration prevention reaches the cleaning device 100, the upper end position of the plate-like member 103 is back to the predetermined position. This makes it possible not to reserve a band image unnecessary for cleaning itself, making it possible to prevent toner from being accumulated in the space B.

As shown hereinabove, the cleaning device 100 of the image forming apparatus 1 according to this embodiment includes the cleaning blade 101 that is in contact with the intermediate transfer belt T and that cleans the intermediate transfer belt T, the applicating roller 102 that is in contact with the intermediate transfer belt T at a position upstream of a part where the cleaning blade 101 is in contact with the intermediate transfer belt T in a conveying direction of the intermediate transfer belt T, and the plate-like member 103 that is in contact with the applicating roller 102 and that applies the toner onto the applicating roller 102. The plate-like member 103 is in contact with the applicating roller at a contact part which is not an edge of the plate-like member 103 and is arranged such that a space for reserving the toner is formed on an upper side of the contact part. The upper end of the plate-like 103 member is lower than the lower end of the cleaning blade 101 and the upper end of the applicating roller 102. The angle θ between a tangent line that passes the upper end of the plate-like member 103 and that touches the applicating roller 102 on the upper side and a horizontal line that passes the upper end of the plate-like member 103 is larger than the angle of rupture β of the toner reserved in the space. Thus, in the cleaning device 100 according to this embodiment, it is possible to suppress accumulation of the reserved toner in the space B even when the fluidity of the reserved toner is worsened, and it is possible to suppress deterioration of the effect of removal of aggregates at the edge by the reverse rotation control. As a result, it is possible to avoid occurrence of cleaning errors caused by foreign substances aggregated at the edge of the cleaning blade (foreign substance meshing and slipping through).

FIG. 12 shows an example of effects compared between the cleaning device 100 in this embodiment and a conventional configuration without limitation of the protrusion amount of the plate-like member 103. In this implementation of printing resistance testing, the actual AccurioPress C3080 was used under the worst conditions for the fluidity of the reserved toner (high temperature and high humidity condition/recycled paper). This printing resistance testing evaluated whether there was accumulation of the reserved toner in the space B and whether there is foreign substance meshing and slipping through.

As shown in FIG. 12, in the configuration of the cleaning device 100 according to this embodiment, as the protrusion amount of the plate-like member 103 was controlled (such that the angle θ is larger than the angle of rupture β), the accumulation of the reserved toner in the space B and the foreign substance meshing and slipping through due to the accumulation were avoided compared to the conventional configuration even when the number of sheets was increased.

The cleaning device 100 according to this embodiment includes the changer (actuator 104) that changes the position of the upper end of the plate-like member 103 and the controller 10 that controls change of the position of the upper end of the plate-like member 103 by the changer based on at least one of an absolute humidity, coverage information, and paper type information. Thus, in the cleaning device 100 according to this embodiment, as the amount of the reserved toner in the space A can be ensured when the fluidity of the reserved toner is not worsened, it is possible to prevent the reserved toner in the space A from running out. As a result, it is possible to prevent the toner from being reserved in the space B and prevent the reserved toner in the space A from running out, suppressing wear of the cut surface due to the running out of the reserved toner in the space A, in all operating conditions.

In the cleaning device 100 according to this embodiment, the changer changes a length from the contact part with the applicating roller 102 of the plate-like member 103 to the upper end of the plate-like member 103, and a length from the starting point of deflection to the contact part with the applicating roller 102 of the plate-like member 103 is constant. Thus, in the cleaning device 100 according to this embodiment, it is possible to avoid change in applicability of the reserved toner onto the intermediate transfer belt T by the applicating roller 102 and stabilize the amount of the reserved toner supplied to the cleaning blade.

In the cleaning device 100 according to this embodiment, the controller 10 controls the change of the position of the upper end of the plate-like member 103 by the changer also during printing. Thus, in the cleaning device 100 according to this embodiment, as the protrusion amount of the plate-like member 103 can be adjusted according to the fluidity of the reserved toner even during the printing operation, it is possible to prevent the toner from being reserved in the space B and prevent the reserved toner in the space A from running out, suppressing wear of the cut surface due to the running out of the reserved toner in the space A, in all operating conditions.

The cleaning device 100 according to this embodiment includes the detector (controller 10) that detects a sliding distance of the applicating roller. The controller 10 controls the change of the position of the upper end of the plate-like member 103 by the changer based on a result of detection by the detector. Thus, in the cleaning device 100 according to this embodiment, as increase in the angle of rupture of the reserved toner due to wear of the applicating roller 102 can be dealt with, it is possible to more reliably avoid accumulation of toner in the space B and avoid cleaning errors due to foreign substances aggregated at the edge of the cleaning blade.

In the cleaning device 100 according to this embodiment, the detector calculates a running distance of the intermediate transfer belt T by integrating a linear speed of the intermediate transfer belt T with respect to a driving time of the drive motor of the intermediate transfer belt T, and specifies the calculated running distance of the intermediate transfer belt T as the sliding distance of the applicating roller 102. Thus, in the cleaning device 100 according to this embodiment, as the running distance of the intermediate transfer belt T can be used, which is easier than to directly detect the sliding distance of the applicating roller 102, it is possible to more easily detect wear of the applicating roller 102 and easily avoid occurrence of cleaning errors caused by foreign substances aggregated at the edge of the cleaning blade.

In the cleaning device 100 according to this embodiment, when a band image for developer deterioration prevention is supplied, the controller 10 changes the position of the upper end of the plate-like member 103 to a lowest position. Thus, in the cleaning device 100 according to this embodiment, as a band image unnecessary for cleaning itself can be prevented from being reserved, it is possible to more reliably avoid accumulation of toner in the space B and occurrence of cleaning errors caused by foreign substances aggregated at the edge of the cleaning blade.

Though the embodiment of the present disclosure has been described in detail, the present disclosure is not limited to the above embodiment, and changes can be made within the scope of the present disclosure.

For example, though the above embodiment includes the actuator 104 that changes the upper end position of the plate-like member 103, the actuator 104 is not an indispensable component, and may be omitted from the configuration. A component that changes the upper end position of the plate-like member 103 is not limited to the actuator 104, and any other configuration is possible.

The detailed configuration and the detailed operation of the devices included in the image forming apparatus can be suitably changed without leaving the scope of the present disclosure.

As used herein, the words "can" and "may" are used in a permissive (i.e., meaning having the potential to), rather than mandatory sense (i.e., meaning must). The words "include," "includes," "including," and the like mean including, but not limited to. Similarly, the singular form of "a" and "the" include plural references unless the context clearly dictates otherwise. And the term "number" shall mean one or an integer greater than one (i.e., a plurality).

What is claimed is:

1. A cleaning device, comprising:

a cleaning blade that is in contact with an image carrier and that cleans the image carrier;

an applicating roller that is in contact with the image carrier at a position upstream of a part where the cleaning blade is in contact with the image carrier in a conveying direction of the image carrier; and a plate-like member that is in contact with the applicating roller and that applies the toner onto the applicating roller, wherein the plate-like member is in contact with the applicating roller at a contact part which is not an edge of the plate-like member and is arranged such that a space for reserving the toner is formed on an upper side of the contact part, wherein an upper end of the plate-like member is lower than a lower end of the cleaning blade and an upper end of the applicating roller, and wherein an angle between a tangent line that passes the upper end of the plate-like member and that touches the applicating roller on an upper side and a horizontal line that passes the upper end of the plate-like member is larger than an angle of rupture of the toner reserved in the space.

2. The cleaning device according to claim 1, further comprising:

a changer that changes a position of the upper end of the plate-like member; and a hardware processor that controls change of the position of the upper end of the plate-like member by the changer based on at least one of an absolute humidity, coverage information, and paper type information.

3. The cleaning device according to claim 2, wherein the changer changes a length from the contact part with the applicating roller of the plate-like member to the upper end of the plate-like member, and wherein a length from a starting point of deflection to the contact part with the applicating roller of the plate-like member is constant.

4. The cleaning device according to claim 2, wherein the hardware processor controls the change of the position of the upper end of the plate-like member by the changer also during printing.

5. The cleaning device according to claim 2, further comprising:

a detector that detects a sliding distance of the applicating roller, wherein the hardware processor controls the change of the position of the upper end of the plate-like member by the changer based on a result of detection by the detector.

6. The cleaning device according to claim 5, wherein the detector:

calculates a running distance of the image carrier by integrating a linear speed of the image carrier with respect to a driving time of a drive motor of the image carrier; and specifies the calculated running distance of the image carrier as the sliding distance of the applicating roller.

7. The cleaning device according to claim 2, wherein, when a band image for developer deterioration prevention is supplied, the hardware processor changes the position of the upper end of the plate-like member to a lowest position.

8. An image forming apparatus, comprising:

an image former that forms an image on a sheet, wherein the image former comprises:

an image carrier with a surface on which a toner image is to be formed;

a transfer unit that transfers the toner image formed on the surface of the image carrier onto the sheet; and the cleaning device according to claim 1 that removes a residue on the surface of the image carrier after the transfer unit transfers the toner image.

* * * * *